US005709615A

United States Patent [19]

Liang

[11] Patent Number: 5,709,615

[45] Date of Patent: Jan. 20, 1998

[54] GOLF CLUB HEAD WITH A HITTING FACE PLATE AND A CLUB NECK WHICH ARE INTEGRALLY FORMED WITH EACH OTHER AND FORMING METHOD THEREFOR

[76] Inventor: Long-Cherng Liang, No. 26, Lane 82, Chung-Cheng Rd., Ta-Liao Hsiang, Kaohsiung Hsien, Taiwan

[21] Appl. No.: 790,525

[22] Filed: Jan. 29, 1997

[51] Int. Cl.[6] ..... A63B 53/04; B22D 19/00

[52] U.S. Cl. ..... 473/324; 473/346; 473/349; 29/428; 29/527.5

[58] Field of Search ..... 473/324, 329, 473/330, 332, 333, 334, 335, 336, 337, 344, 345, 346, 347, 349, 350; 29/422, 428, 464, 469, 527.1, 527.5; 228/141.1, 262.6

[56] References Cited

U.S. PATENT DOCUMENTS 1,678,637 7/1928 Drevitson .
4,432,549 2/1984 Zebelean .
4,635,941 1/1987 Yoneyama .
4,984,800 1/1991 Hamada .
5,000,454 3/1991 Soda .
5,271,621 12/1993 Lo .
5,533,729 7/1996 Leu .
5,564,994 10/1996 Chang .

*Primary Examiner*—Sebastiano Passaniti
*Attorney, Agent, or Firm*—Ladas & Parry

[57] ABSTRACT

A golf club head includes a hitting face plate and a club neck which are integrally formed from copper. The hitting face plate has a rear face integrally formed with a plurality of insert posts projecting rearward therefrom. Each of the posts has an inner end integrally formed with the hitting face plate, and an enlarged outer end. A club head body is molded over the hitting face plate and the club neck, and is made of a metal which has a melting point lower than that of copper. The posts are embedded in the club head body. The golf club head is formed by a process which includes the steps of forming a copper blank piece which consists of the hitting face plate and the club neck, enlarging the outer ends of the posts, and molding the club head body over the copper blank piece.

6 Claims, 4 Drawing Sheets

GOLF CLUB HEAD WITH A HITTING FACE PLATE AND A CLUB NECK WHICH ARE INTEGRALLY FORMED WITH EACH OTHER AND FORMING METHOD THEREFOR

BACKGROUND OF TEE INVENTION

1. Field of the Invention

This invention relates to a golf club head, more particularly to a golf club head which has a hitting face plate and a club neck that are integrally formed from copper so as to strengthen the golf club head, and which is formed by a simple process.

2. Description of the Related Art

Generally, owing to different purposes and functions, several types of golf clubs, such as wood clubs, iron clubs and putter clubs, are available in the market. The main difference of these golf clubs lies in their golf club heads. Accordingly, different casting methods are employed extensively to mold these golf club heads according to their required shapes. For example, a lost wax casting process can be employed to mold the heads of wood clubs, while a die casting process can be employed to mold the heads of iron clubs or putter clubs. To provide a desired sound created from striking of a golf club head on a ball, a hitting face plate is formed by a metal in advance so as to mold thereon a club head body and a club neck which are made of another metal. In the fabrication of this kind of golf club head, a hollow cylinder is placed into the molds in order to form the club neck therein, thus causing inconvenience in the molding process.

SUMMARY OF THE INVENTION

An object of this invention is to provide a golf club head which is formed by a simple process.

Another object of this invention is to provide a golf club head which has a hitting face plate and a club neck that are integrally formed from copper.

According to this invention, a golf club head includes a hitting face plate and a club neck which are integrally formed from copper. The hitting face plate has a rear face integrally formed with a plurality of insert posts projecting rearward therefrom. Each of the posts has an inner end integrally formed with the hitting face plate, and an enlarged outer end. A club head body is molded over the hitting face plate and the club neck, and is made of a metal which has a melting point lower than that of copper. The posts are embedded in the club head body.

Preferably, the rear face of the hitting face plate is further provided with a plurality of positioning blocks, and a plurality of spaced-apart reinforcing ribs. The positioning blocks are formed along the outer periphery of the hitting face plate so as to position the hitting face plate on the club head body when molding the club head body over the hitting face plate and the club neck. Each of the reinforcing ribs extends over the rear face and interconnects an adjacent pair of the posts. The club neck has a lower end surface which is exposed to and flush with an outer surface of the club head body which is located around the lower end surface of the club neck.

The golf club head is formed by a process which includes the steps of:

(1) forming a copper blank piece which consists of the hitting face plate and the club neck, (2) enlarging the outer ends of the posts, and (3) molding the club head body over the copper blank piece.

BRIEF DESCRIPTION OF THE DRAWING

Other features and advantages of this invention will become apparent in the following detailed description of the preferred embodiment of this invention with reference to the accompanying drawings, in which.

DETAILED DESCRIPTION OF THE PREFERRED EMBODIMENT

Figure 1:
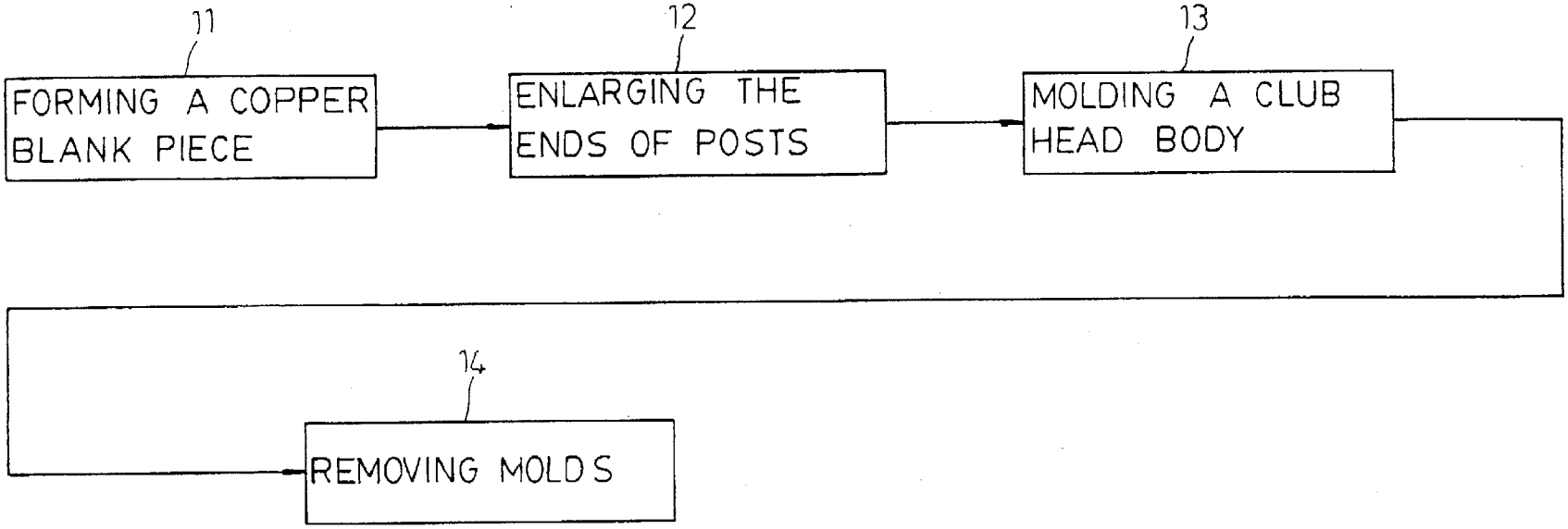
FIG. 1 is a flow diagram illustrating a method for forming a golf club head according to this invention.

Referring to FIG. 1, a method for forming a golf club head according to this invention includes a first step 11 of forming a copper blank piece, a second step 12 of enlarging the ends of posts, a third step 13 of molding a club head body, and a fourth step 14 of removing molds.

Figure 2:
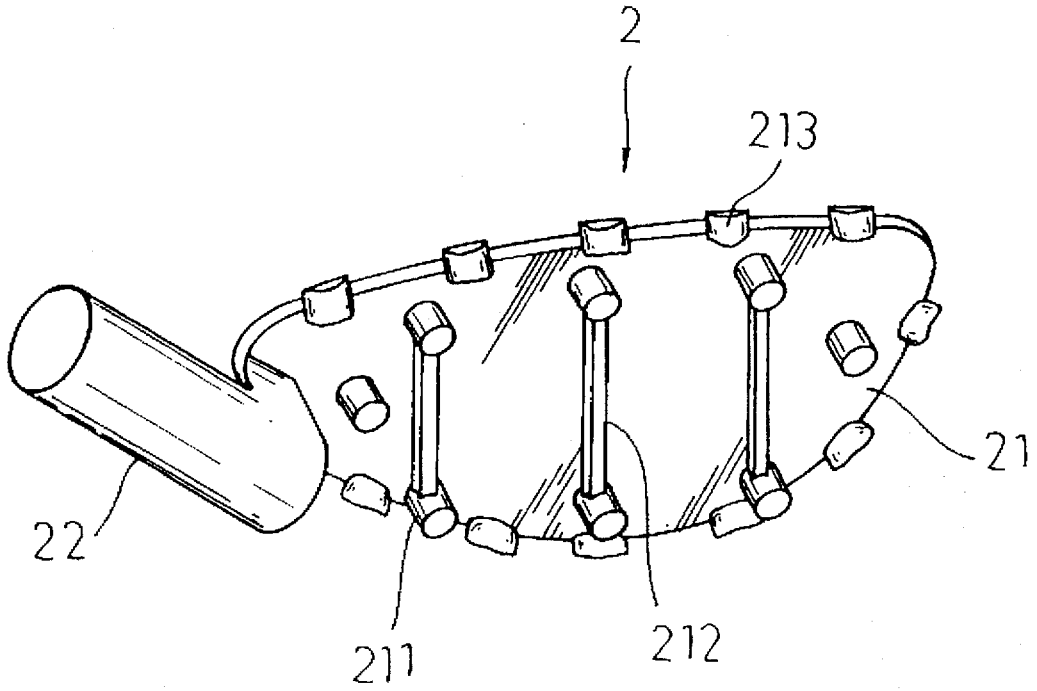
FIG. 2 is a perspective view of a copper blank piece which is formed by the first step of the method according to this invention.

As shown in FIG. 2, the copper blank piece 2 formed in the first step consists of a hitting face plate 21 and a club neck 22 which are integrally formed with each other. The rear face of the hitting face plate 21 is integrally formed with a plurality of insert posts 211 projecting rearward therefrom, a plurality of spaced-apart reinforcing ribs 212, each of which extends over the rear face and interconnects an adjacent pair of the posts 211, and a plurality of positioning blocks 213 located along the outer periphery of the hitting face plate 21. Each of the posts 211 has an inner end integrally formed with the hitting face plate 21, and an outer end.

The second step of the method of this invention is to enlarge the outer ends of the posts 211. The third step of the method is to mold a club head body over the copper blank piece 2 so that the posts 211, whose outer ends have been enlarged, are embedded in the club head body, thereby forming the golf club head. The club body is made of aluminum which has a melting point of 660° C. which is lower than the melting point of copper which is 1100° C., so as to permit molding of the club head body on the copper blank piece 2.

Figure 3:
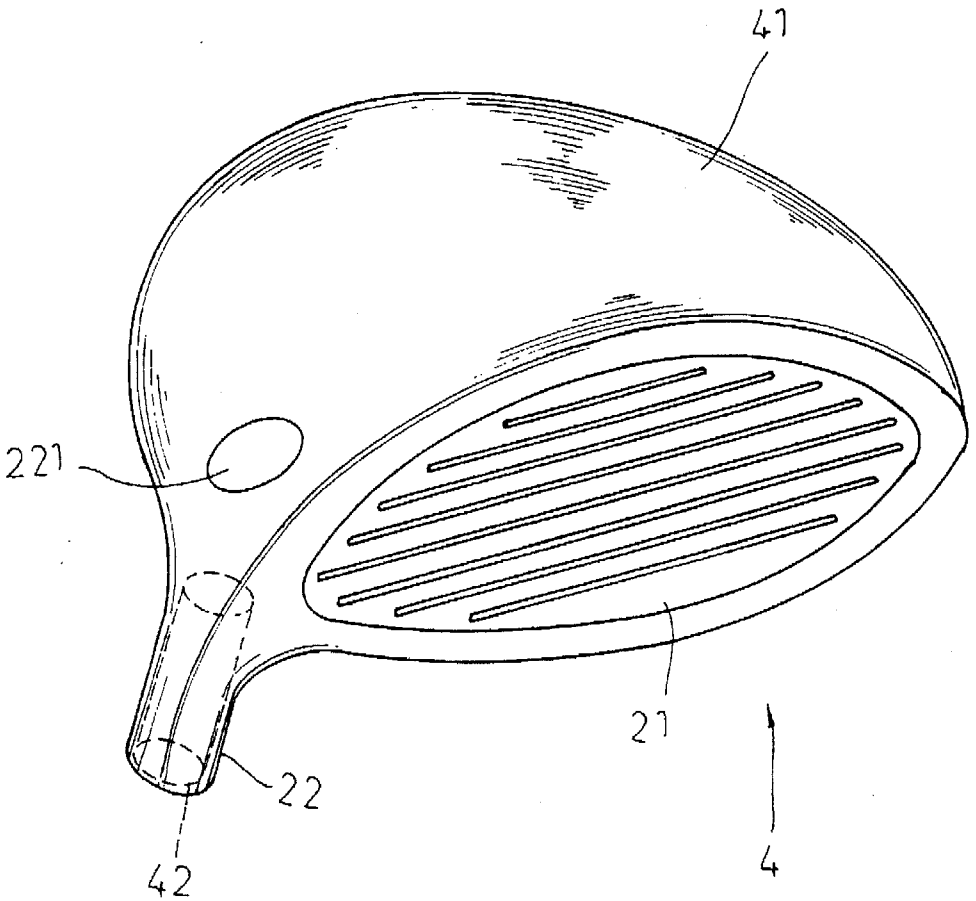
FIG. 3 is a perspective view showing the golf club head of this invention.

FIG. 3 shows the golf club head 4 which is formed by the method illustrated in FIG. 1. As illustrated, the lower end surface of the club neck 22 is exposed to and flush with the outer surface of the club body 41 located therearound so as to vary the outer appearance of the golf club head 4, due to the different colors of copper and aluminum. The upper end surface of the club neck 22 is drilled to form a central bore 42 into which a club shaft can be inserted.

Figure 4:
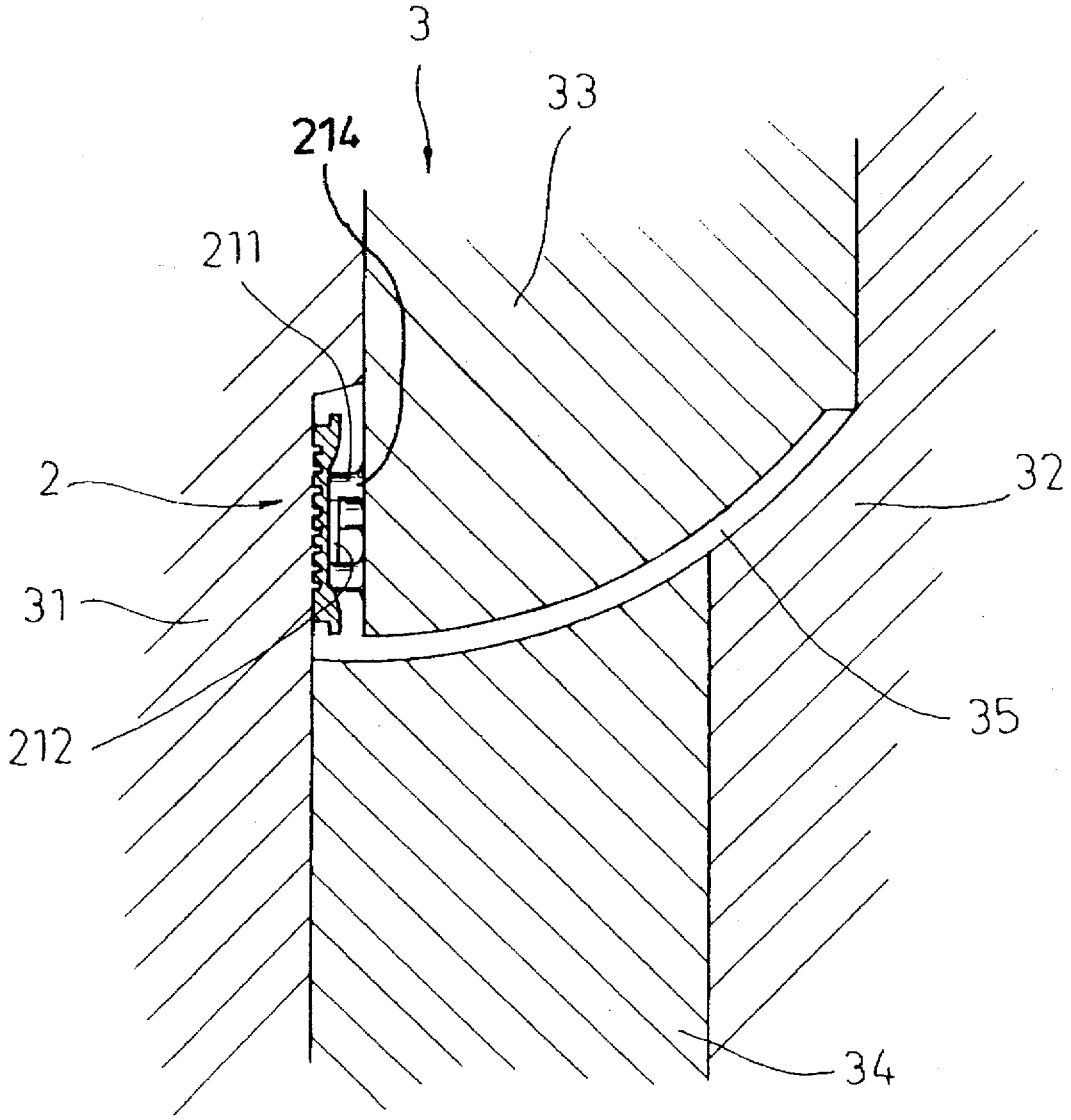
FIG. 4 is a sectional view illustrating a pair of molds and a pair of punches which are employed to perform the second and third steps of the method according to this invention.

It is understood that the outer ends of the posts can be enlarged prior to placing the copper blank piece into the molds. The enlargement of the outer ends of the posts can also be effected at the time the club head body is molded over the copper blank piece. For example, the enlarging step and the molding step can be effected by means of the device, as shown in FIG. 4, which includes a male mold 31, a female mold 32, an upper punch 33 and a lower punch 34. In operation, the copper blank piece 2 is placed into a molding space 35 defined between the male mold 31 and the female mold 32. The upper punch 33 is inserted downward into the molding space 35 to contact the posts 211 so as to press the copper blank piece 2 against the male mold 31, thereby forming the enlarged outer ends 214 of the posts 211. The lower punch 34 is inserted upward into the molding space 35. Then, melt of the metal is poured into the portion of the molding space 35 between the molds 31 and 32 and between the punches 33 and 34 so as to mold the club head body over the copper blank piece 2. Finally, the molds 31, 32 and the punches 33, 34 are removed from the molding space 35.

It can be appreciated that, because the copper blank piece 2 is formed as a single piece, the strength of the golf club head is increased.

With this invention thus explained, it is apparent that numerous modifications and variations can be made without departing from the scope and spirit of this invention. It is therefore intended that this invention be limited only as indicated in the appended claims.

I claim:

1. A method for forming a golf club head, comprising the steps of:

(1) forming a copper blank piece which consists of a hitting face plate and a club neck that are integrally formed with each other, said hitting face plate having a rear face integrally formed with a plurality of insert posts projecting rearward therefrom, each of said posts having an inner end integrally formed with said hitting face plate, and an outer end;

(2) enlarging said outer ends of said posts; and (3) molding a club head body over said copper blank piece so that said posts are embedded in said club body, said club body being made of a metal which has a melting point lower than that of copper.

2. A method as claimed in claim 1, wherein said steps (2) and (3) are effected by the steps of:

placing said copper blank piece into a molding space between a male mold and a female mold, inserting an upper punch downward into the molding space to contact said posts so as to press said copper blank piece against said male mold, thus enlarging said outer ends of said posts, inserting a lower punch upward into the molding space, pouring melt of the metal into said molding space so as to mold said club head body over said copper blank piece; and removing said male mold, said female mold, said upper punch and said lower punch from said molding space.

3. A golf club head comprising:

a hitting face plate made of copper and having a rear face integrally formed with a plurality of insert posts projecting rearward therefrom, each of said posts having an inner end integrally formed with said hitting face plate, and an enlarged outer end;

a club neck integrally formed with said hitting face plate; and a club head body molded over said hitting face plate and said club neck and being made of a metal which has a melting point lower than that of copper, said posts being embedded in said club head body.

4. A golf club head as claimed in claim 3, wherein said rear face of said hitting face plate is integrally formed with a plurality of positioning blocks along an outer periphery thereof so as to position said hitting face plate on said club head body when molding said club head body over said hitting face plate and said club neck.

5. A golf club head as claimed in claim 3, wherein said rear face of said hitting face plate is integrally formed with a plurality of spaced-apart reinforcing ribs, each of which extends over said rear face and interconnects an adjacent pair of said posts.

6. A golf club head as claimed in claim 3, wherein said club neck has a lower end surface which is exposed to and flush with an outer surface of said club head body which is located around said lower end surface of said club neck.

* * * * *